United States Patent [19]

Tatham

[11] Patent Number: 5,069,492

[45] Date of Patent: Dec. 3, 1991

[54] AUTOMATIC SLIDING DOOR LATCH

[76] Inventor: Gerald F. Tatham, 1391 W. Shaw Ave., Fresno, Calif. 93711

[21] Appl. No.: 652,443

[22] Filed: Feb. 6, 1991

Related U.S. Application Data

[63] Continuation-in-part of Ser. No. 532,196, Jun. 1, 1990, abandoned.

[51] Int. Cl.[5] ..... E05C 19/06

[52] U.S. Cl. ..... 292/85; 292/DIG. 46

[58] Field of Search ..... 292/246, 80, 85, 87, 292/716.46

[56] References Cited

U.S. PATENT DOCUMENTS

| | | | |
|---|---|---|---|
| 46,472 | 2/1865 | Jenks | 292/85 |
| 530,078 | 12/1894 | Ammerman | 292/85 |
| 2,926,037 | 2/1960 | Granzow | 292/DIG. 46 |
| 2,978,757 | 4/1961 | Ammerman | 292/246 |
| 3,065,985 | 11/1962 | Du Four | 292/DIG. 46 |
| 3,140,889 | 7/1964 | Sanders | 292/DIG. 46 |
| 3,827,738 | 8/1974 | Dushane, Jr. | 292/DIG. 46 |
| 3,877,739 | 4/1975 | Cowen | 292/DIG. 46 |

FOREIGN PATENT DOCUMENTS

| | | | |
|---|---|---|---|
| 1228966 | 3/1960 | France | 292/85 |
| 583469 | 10/1958 | Italy | 292/85 |

*Primary Examiner*—Eric K. Nicholson

*Attorney, Agent, or Firm*—Mark D. Miller

[57] ABSTRACT

An automatic sliding door or window latching device which includes a hook attached to a door or window jamb immediately opposite the door or window frame where a merchanism containing a bendable plate having a hole in the center thereof is placed. When the door or window is pushed closed, the plate moves up over the hook until the opening is reached at which point said plate snaps firmly against said hook. The plate is attached to an axle and corresponding handles such that when one of said handles is turned, the plate moves away from said hook, unlatching the door or window. In order to avoid deforming the plate during use, the range of rotation of said handles may be limited according to the size of an opening into which a tab attached to a key slided over said axle is displaced.

12 Claims, 6 Drawing Sheets

AUTOMATIC SLIDING DOOR LATCH

This is a continuation-in-part of copending application Ser. No. 07/532,196, filed on June 1, 1990, now abandoned.

BACKGROUND OF THE INVENTION

The present invention relates to an automatic latching device for a sliding door or a window. With the advent of improved sliding door and window closing mechanisms, the need has arisen for an automatic latching mechanism to hold the door or window in place once it has been pushed closed.

Virtually all sliding door and window latching mechanisms known to the inventor require the user to affirmatively close the latch by turning, twisting, pushing or pulling some mechanism once the door or window is closed. Certain spring loaded automatic latching mechanisms (such as those used on outdoor screen doors) are well known in the art, but no similar mechanism has been developed for a sliding door or window.

It is therefore the principal object of this invention to provide an automatic latching mechanism for use on a sliding door or window.

It is a further object of this invention to provide a latching mechanism for use on a sliding door or window that employs the same handle to both unlatch the door or window and to pull the door or window open.

It is a further object of this invention to provide an automatic latching mechanism for a sliding door or window that may be used in connection with the improved sliding door closer of U.S. Pat. No. 4,884,369 to hold a sliding door or window in place once it has been pushed flush with the jamb.

DETAILED DESCRIPTION OF THE DRAWINGS

No attempt is made to show structural details of the invention in more detail than is necessary for a fundamental understanding of the invention, the description taken with drawings making apparent to those skilled in the art how the several forms of the invention may be embodied in practice.

Figure 1:
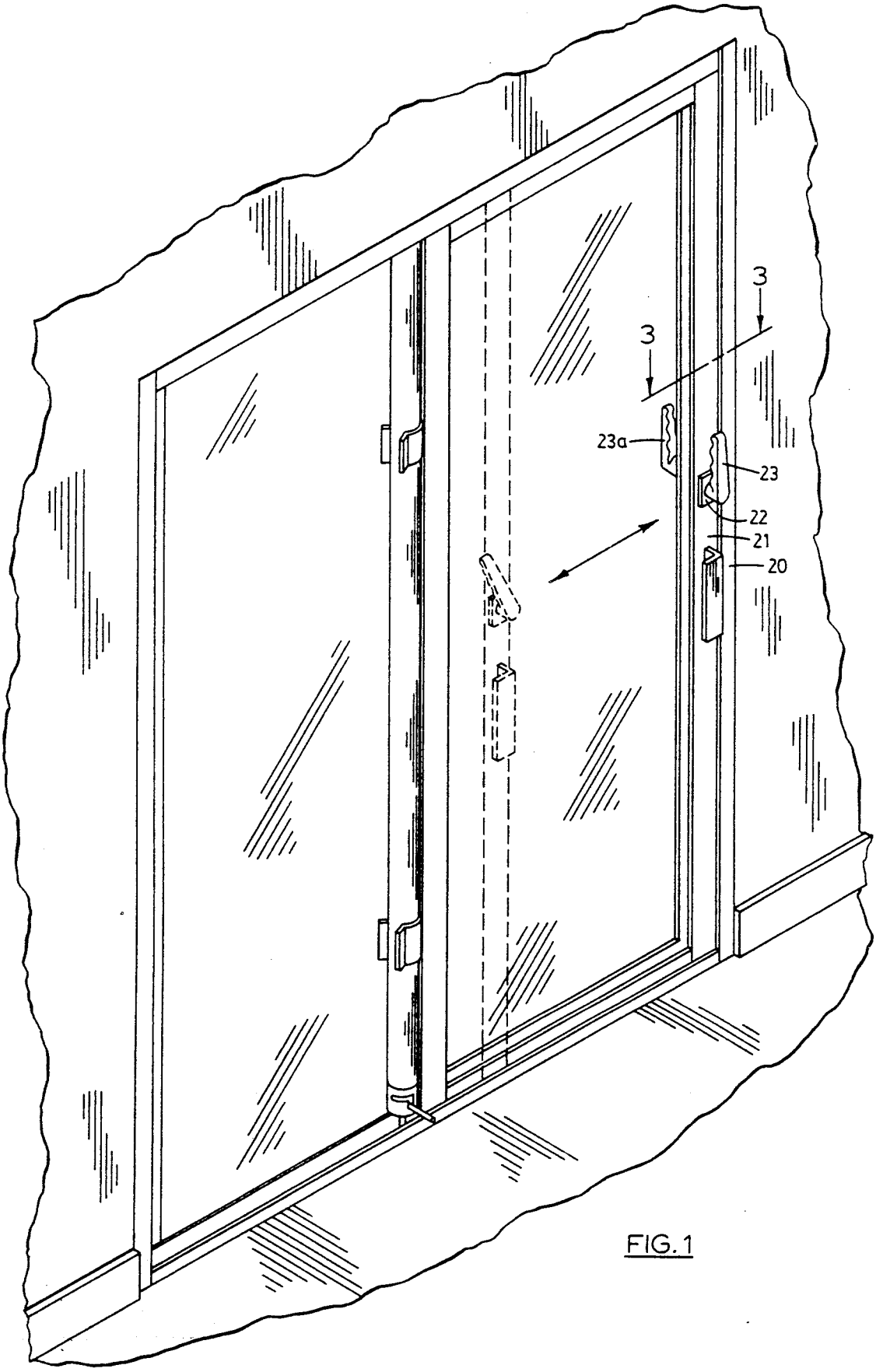
FIG. 1 is an environmental view of the invention in place on a sliding glass door.
Figure 1A:
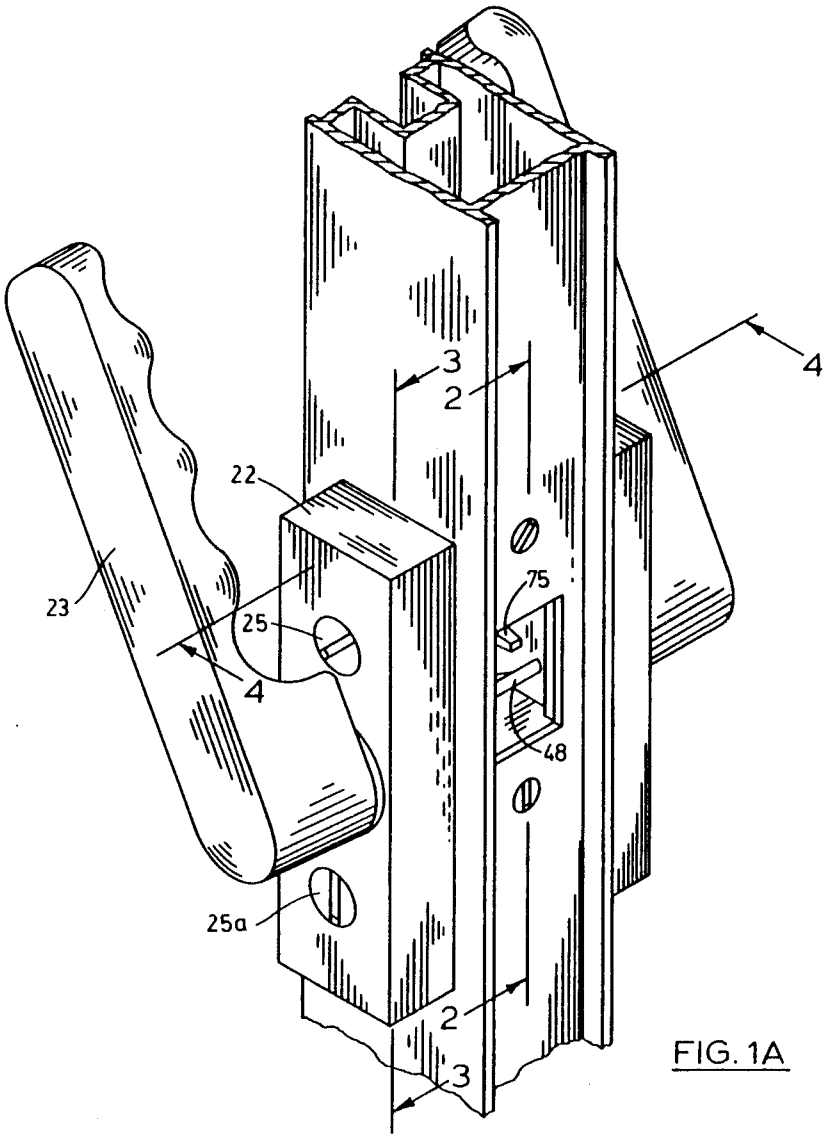
FIG. 1A is an assembled view of an alternative embodiment of the automatic latching mechanism of the present invention in a metal door or window frame.
Figure 4A:
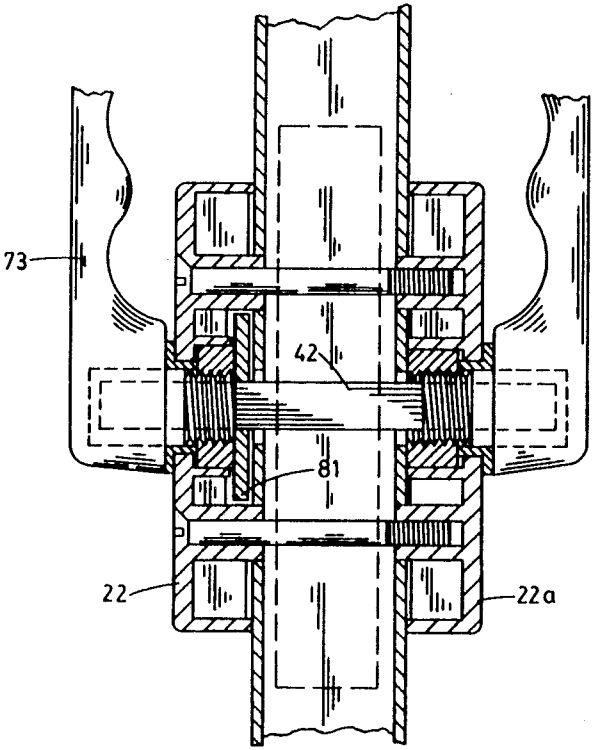
FIG. 4A is a top cutaway view of the invention along line 4—4 of FIG. 1A.
Figure 2:
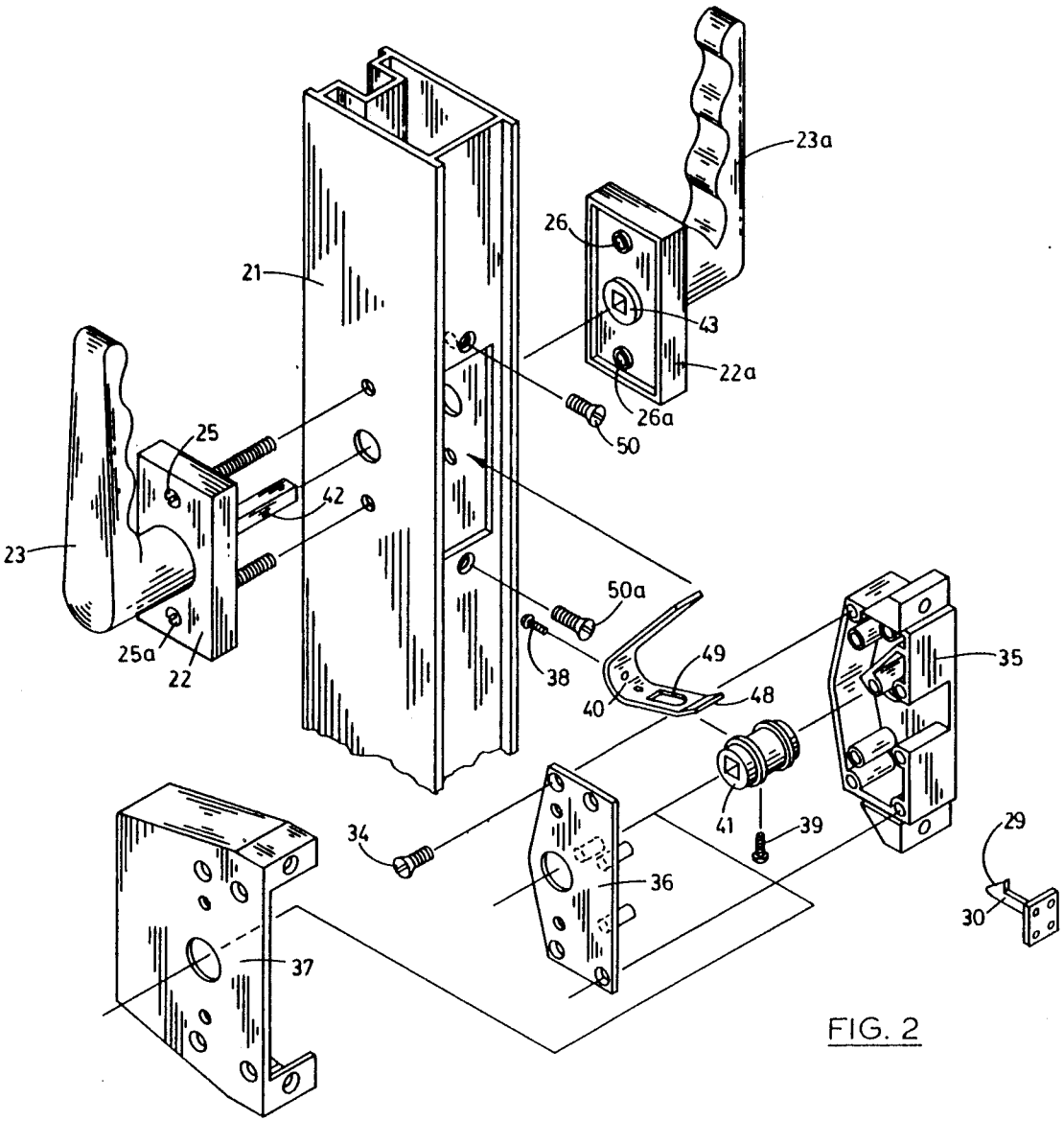
FIG. 2 is an exploded view of the various parts of the automatic latching mechanism of the present invention.
Figure 4:
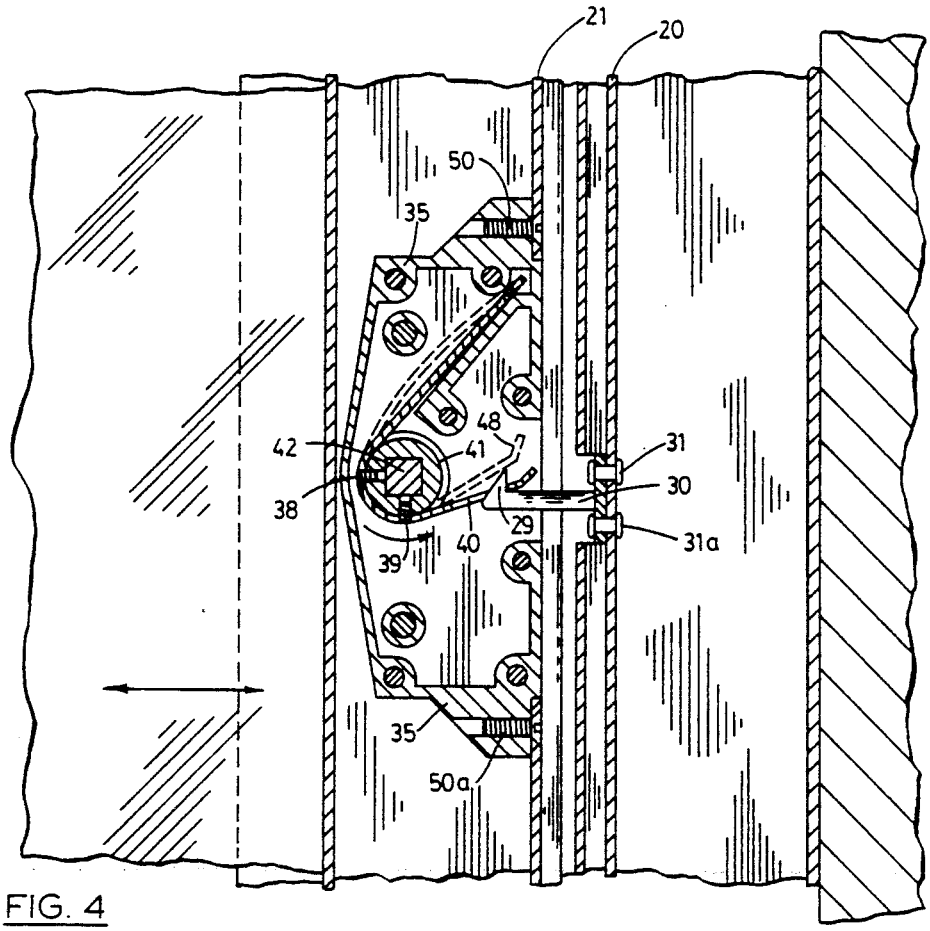
FIG. 4 is a side cutaway view of the invention along line 4—4 of FIG. 3..
Figure 7:
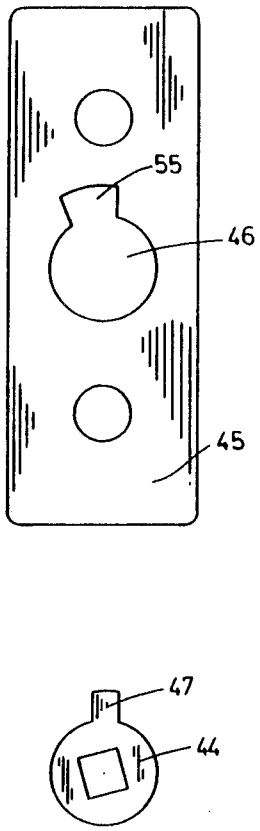
FIG. 7 is a view of a plate and key used to limit the rotation of the latching mechanism.

Like reference characters throughout the several views of the invention refer to the same features. With reference to FIG. 2 and FIG. 4, it can be seen that the present invention is comprised of a hook 30 and Ridge 29 mounted by 29 means 31 and 31*a* to a door or window jamb 20 so that the Ridge protrudes out from the jamb 20. The latching mechanism itself may be mounted inside the frame 21 of a door or window, or may be mounted flush (see FIG. 5), or as an insert (see FIG. 6).

The unique central feature of the latching mechanism is a bendable molded plate 40 having a lip 48 at one end, and an opening 49 immediately behind said lip (see FIG. 2). The plate 40 is fixedly attached to rotatable drum 41 by means 38 and 39. This plate-and-drum assembly (40, 41) is thereafter placed within housing 35 so that the lip 48 protrudes freely within the housing, and the end of plate 40 opposite the lip is rigidly anchored to housing 35, as shown in FIG. 4. Housing 35 has a counter-part 36 which attaches to housing 35 by means 34 such that the drum 41 to which plate 40 is attached may rotate around a central axis. Drum 41 has a squared central opening through which axle 42 may slidably pass.

Figure 2A:
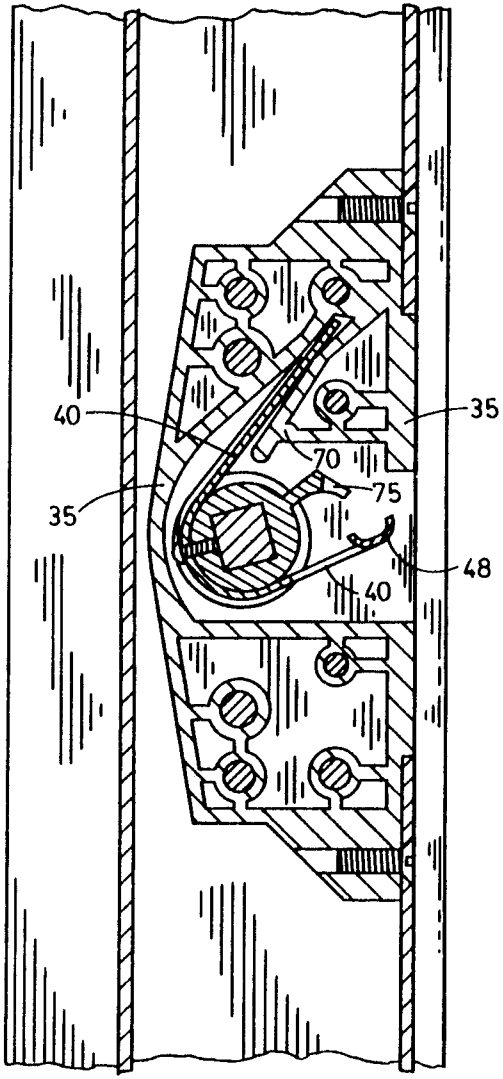
FIG. 2A is a side cutaway view of the invention along line 2—2 of FIG. 1A.

In the alternative embodiment shown in FIG. 2A, drum 41 is provided with a L-shaped tab 75. Housing 35 is slightly modified to include an opening for said tab 75 having an upper limit at wall 70. The rotation of drum 41 within housing 35 is restricted by tab 75 as it comes into contact with wall 70 during rotation. This restriction prevents the impartation of unnecessary stress to bendable molded plate 40.

Figure 6:
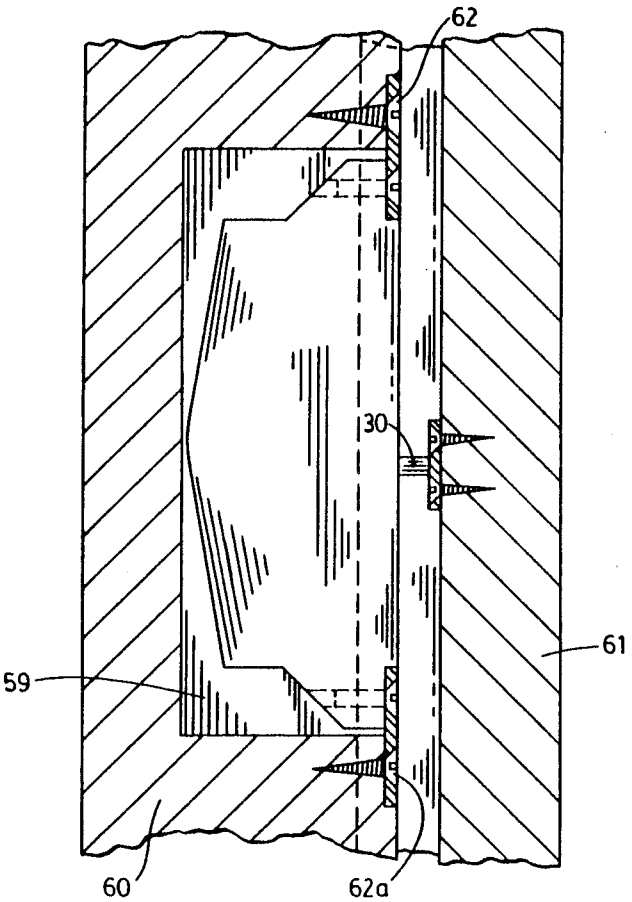
FIG. 6 is a cutaway view of the insert used for mounting the invention in a wooden door.
Figure 5:
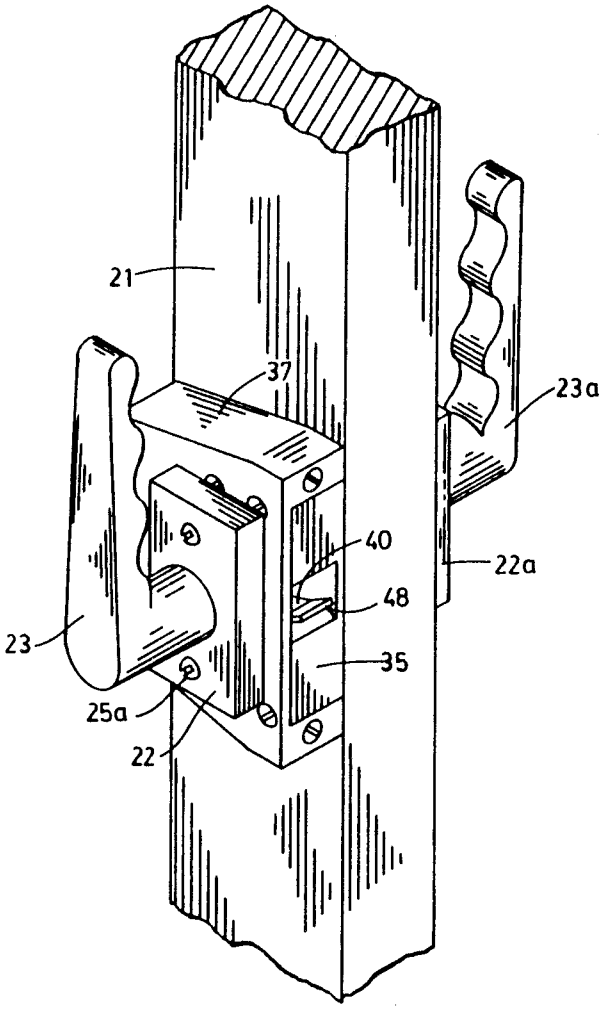
FIG. 5 is a view of an alternative embodiment of the invention used for flush mounting.

The housing assembly 35, 36 containing the plate-and-drum assembly may be attached to the door or window frame by means 50 and 50A; or to flush mounting bracket 37 as shown in FIG. 5; or to wooden door insert 59 as shown in FIG. 6.

Handle means 23 and 23*a* are provided on either side of the door frame 21, attached to mounting brackets 22 and 22*a*, respectively. A squared axle 42 is disposed between handles 23 and 23*a*, and passes through the squared opening through the middle of drum 41. Attachment means 25 and 25*a* hold brackets 22 and 22*a* in place on either side of the door frame 21.

A special plate 45 may be employed between the door frame 21 and either plate 22 or plate 22*a*. Plate 45 works in connection with a specially designed key-shaped piece 44 having a squared opening through its middle. Key-shaped piece 44 is placed in a modified bell shaped opening 46 in plate 45. Piece 44 has a small knob 47 at one end. Opening 46 has a corresponding space 55 that is slightly wider than knob 47. When plate 45 is used, axle 42 passes through the squared opening in piece 44; piece 44 is thereafter loosably placed in opening 46 of plate 45 such that knob 47 is in space 55. The size of space 55 restricts the movement of knob 47 of piece 44, and hence restricts the amount of rotation that piece 44 will allow axle 42 to turn. This limitation avoids allowing the user to impart undue stress to the drum 41 attached to bendable molded plate 40.

Figure 3A:
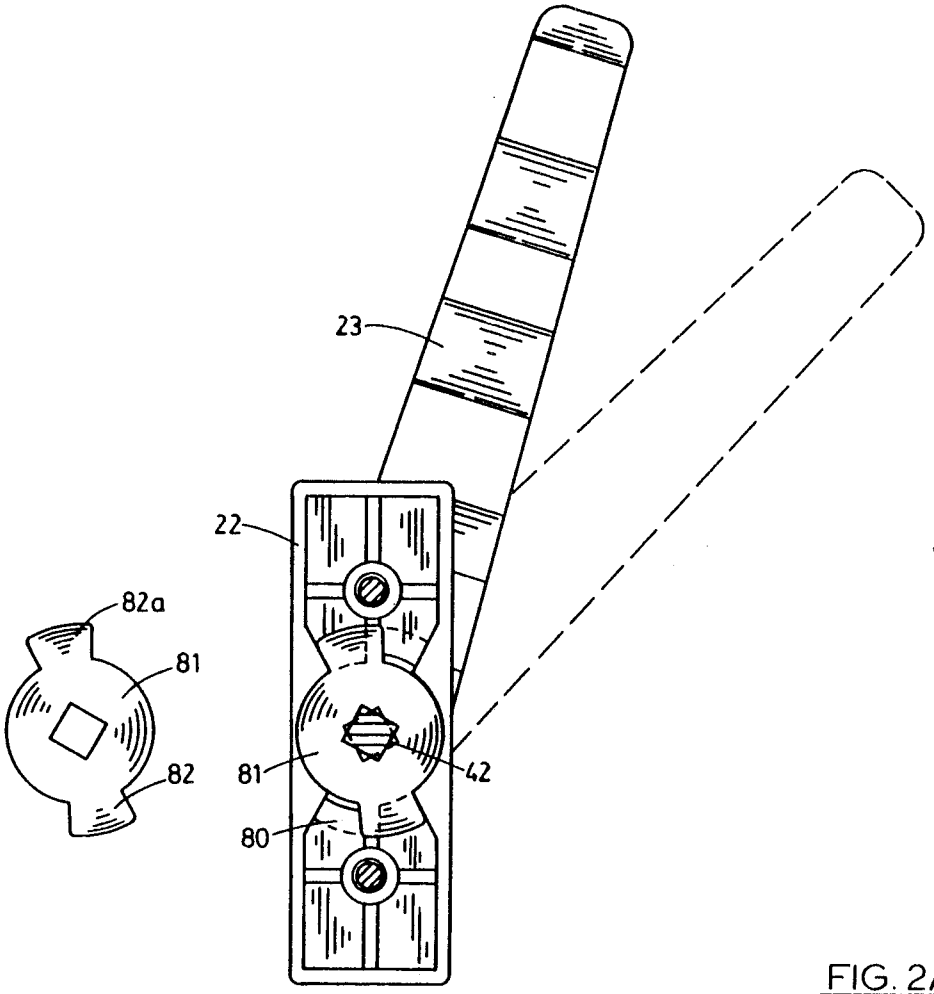
FIG. 3A is a side cutaway view of the invention along line 3—3 of FIG. 1A.
Figure 3:
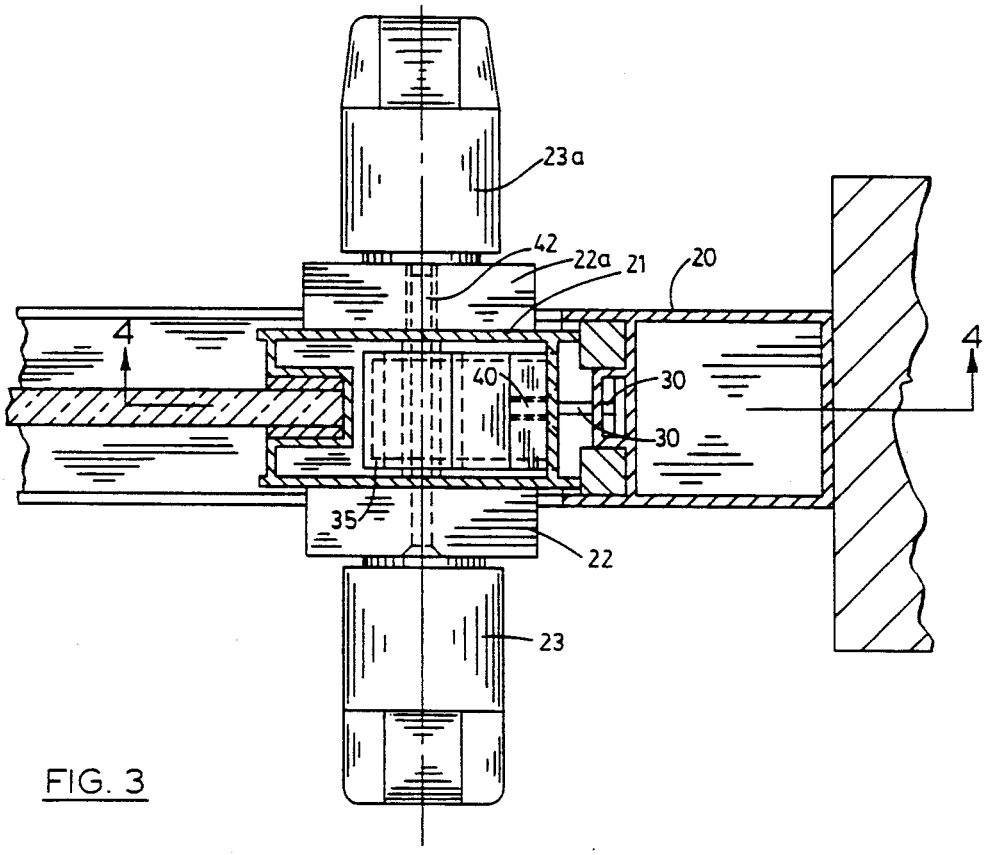
FIG. 3 is a top cutaway view of the invention along line 3—3 of FIG. 1.

In the alternative embodiment shown in FIG. 3A, mounting bracket 22 (or 22*a*) is provided with a flattened interior region in the shape of a modified hour glass 80 having a wide central area through which axle 42 may pass. A modified flattened disk 81 having a squared hole in the middle, and two tabs 82, and 82*a* at opposite ends fits loosably in the modified hour glass opening 80. The tabs 82 and 82*a* of disk 81 are slightly smaller than the corresponding openings of the modified hour glass region 80. Once axle 42 is passed through disk 81 in place in region 80, its rotation is restricted by the amount of movement that tabs 82 and 82*a* may make within region 80. The resulting restriction prevents impartation of undue stress along axle 42 to the bendable molded plate 40.

In particular, by restricting the rotation of the axle, and hence the handle, the modified disk 81 allows the handle to be used to pull the door or window open by placing virtually all stress from the handle 23 on mounting bracket 22, and virtually no undue stress on bendable molded plate 40.

DESCRIPTION OF THE PREFERRED EMBODIMENT

In operation, the automatic sliding door or window latch of the present invention can be mounted either inside a metallic sliding glass door or window frame, flush within a wooden sliding door or window frame, or in an insert within a wooden sliding door or window frame. The central feature of the invention is a bendable molded plate 40 which is attached to a drum 41 in the center of the latch mechanism. A limiting key-and-plate assembly 44, 45 restricts the amount of torque that may be imparted to plate 40 by axle 42 attached to handles 23 and 23*a*. This way, the bendable molded plate 40 is never bent so far out of shape that it will not latch with hook means 30.

Said bendable molded plate has an opening 49 in the middle thereof just behind a lip 48. The opposite end of plate 40 is rigidly anchored within the mounting bracket 35 of the mechanism in the door frame 21. This leaves the lip 48 end of plate 40 hanging freely in an opening in the middle of bracket 35.

Hook 30 is attached to the door jamb immediately opposite the bendable molded plate 40. When the door is closed ridge 29 of hook 30 pushes lip 48 of plate 40 upward until opening 49 is directly above ridge 29. At such point, plate 40 snaps into place onto hook 30, ridge 29 protruding through opening 49. This connection holds the door frame 21 in place until such time as the user desires to open the door.

The door may be opened by turning handle 23 or 23*a* upwards so that axle 42 is rotated, imparting the same rotation to drum 41. Since drum 41 is fixedly attached to the bendable plate 40 by means 38 and 39, plate 40 moves in harmony with axle 42. When sufficient torque is applied, plate 40 is released from hook 30, allowing the door to be reopened.

Other embodiments allow the latching mechanism of the present invention to be installed flush on the side of a wooden door, or inserted within a wooden door.

The advantage of the present invention is that the normal momentum of the closing of a door or window is usually enough to bend plate 40 upward so that it latches against hook 30. Nothing more is required other than sliding the door or window frame up against the jamb.

While this invention has been described with a certain degree of particularity, it is manifest that many changes may be made in the details of construction and the arrangement of components without departing from the spirit and scope of the disclosure. It is understood that the invention is not limited to the embodiment set forth herein for purposes of exemplification, but is limited only by the scope of the attached claim or claims, including the full range of equivalency to which each element thereof is entitled.

I claim:

1. An automatic sliding door or window latching mechanism comprising:

a. a hook means attached to a door or window jamb;

b. a housing attached to a door or window frame opposite said hook means;

c. a rotatable drum having a square opening through the center thereof rotatably mounted within said housing;

d. a bendable plate member fixedly attached to said drum, said plate member having an upwardly bent lip on one end, and a central opening immediately adjacent to said lip, said plate mounted within said housing so that the lip and central opening of said plate are directly opposite the hook, the opposite end of said plate being fixedly anchored to said housing;

e. a square axle slidably passing through the squared opening in said drum, and attached on its opposite ends to a pair of handle means;

f. means for attaching said housing to said door or window;

g. means for attaching said handle means to said axle;

h. means for attaching said handle means to said door or window.

2. The invention described in claim 1 wherein a separate handle rotation limiting mechanism is provided adjacent to said handle attaching means comprising:

a. a plate having a modified bell shaped opening therein;

b. a flat rounded piece having a squared opening therein;

c. a knob located on said flat rounded piece, said knob being slightly smaller than the corresponding bell-shaped opening for it in said plate;

whereby the axle of said invention passes through said flat, rounded piece, which piece is, in turn, placed within said bell-shaped opening of said plate such that the size of the opening in the plate limits the amount of rotation of the piece and hence of said axle.

3. The invention described in claim 2 wherein said housing is installed flush on the side of a wooden door or window.

4. The invention described in claim 2 wherein said housing is inserted within a wooden door or window.

5. The invention described in claim 2 wherein said housing is inserted within a metal door or window.

6. The invention described in claim 1 wherein said rotatable drum has an L-shaped tab located thereon, and said housing is provided with an opening and an upper wall which restricts the rotation of said drum as said L-shaped piece comes in contact with said wall of said housing.

7. The invention described in claim 2 wherein said rotatable drum has an L-shaped tab located thereon, and said housing is provided with an opening and an upper wall which restricts the rotation of said drum as said L-shaped piece comes in contact with said wall of said housing.

8. The invention described in claim 1 wherein said means for attaching the handle means to the door or window includes a flattened opening having a modified hourglass shape with a wide middle, and a flat rounded piece having a pair of knobs located on opposite sides thereof and a squared opening in the middle is provided, such tat each of said knobs fits loosably in one end of said hourglass shaped opening, whereby the rotation of the flat rounded piece within the modified hourglass opening is restricted, preventing the axle passing through said flat rounded piece from excessive rotation, allowing all torque imparted from said handle means to said axle to be applied to said flat rounded piece so as to assist in the opening or closing of the door or window, and preventing unnecessary stress on said bendable plate member.

9. The invention described in claim 8 wherein said housing is installed flush on the side of a wooden door or window.

10. The invention described in claim 8 wherein said housing is inserted within a wooden door or window.

11. The invention described in claim 8 wherein said housing is inserted within a metal door or window.

12. The invention described in claim 2 wherein the opening in said plate has a modified hour glass shape with a wide middle, and said flat rounded piece has a pair of knobs located on opposite sides thereof, such that each of said knobs fits loosably in one end of said hour glass shaped opening, whereby the rotation of the flat rounded piece within the modified hour glass shaped opening is restricted, preventing the axle passing through said flat rounded piece from excessive rotation, allowing all torque imparted from said handle means to said axle to be applied to said plate so as to assist in the opening or closing of the door or window, and preventing unnecessary stress on said bendable plate member.

* * * * *